US006402664B1

(12) United States Patent
Marston

(10) Patent No.: US 6,402,664 B1
(45) Date of Patent: Jun. 11, 2002

(54) THERAPEUTIC AND RECREATIONAL VARIABLE STEPPING APPARATUS AND METHOD

(76) Inventor: Thomas J. Marston, 21 South St., Box 35, South Bethlehem, NY (US) 12161

( * ) Notice: Subject to any disclaimer, the term of this patent is extended or adjusted under 35 U.S.C. 154(b) by 0 days.

(21) Appl. No.: 09/429,464

(22) Filed: Oct. 28, 1999

(51) Int. Cl.[7] ..... A63B 22/00
(52) U.S. Cl. ..... 482/52; 482/51
(58) Field of Search ..... 482/51, 52, 53; 297/440.14; 52/590.2, 604; 446/119; 273/241, 260, 239, 157 R

(56) References Cited

U.S. PATENT DOCUMENTS 3,672,681 A * 6/1972 Wolf ..... 273/157 R
3,871,657 A * 3/1975 Lorenz et al. ..... 273/239
5,540,638 A * 7/1996 Wilkinson ..... 482/52
6,063,007 A * 5/2000 Sithole ..... 482/52

* cited by examiner

*Primary Examiner*—Stephen R. Crow
(74) *Attorney, Agent, or Firm*—Jay R. Yablon

(57) ABSTRACT

Six steps of varying height are provided adjacent to one another in an integrated unit resting upon and surrounded by a floor surface. The height of each step in relation to its adjacent steps, and in relation to the floor, is determined such that by stepping between any chosen pair of adjacent steps, or by stepping between the floor and any given single step, step height differentials of approximately 2, 4, 6, 8, 10, 12, 14, 16, 18, 20, 22, 24, and optionally 26 inches are all made available to the user.

33 Claims, 7 Drawing Sheets

| Step Reference # in FIGS. 1 & 5 | Height Above Floor 10 |
|---|---|
| 11 | 24 inches |
| 12 | 10 inches |
| 13 | 22 inches |
| 14 | 6 inches |
| 15 | 2 inches |
| 16 | 20 inches |

FIG. 2

| Step Reference # in FIG. 5 | Height Above Floor 10 |
|---|---|
| 11 | 24 inches |
| 12 | 8 inches |
| 13 | 26 inches |
| 14 | 22 inches |
| 15 | 2 inches |
| 16 | 14 inches |

FIG. 6

| To Achieve Desired Height Differential of: | Step Between A/B |
|---|---|
| 2 inches | 10/15 |
| 4 inches | 14/15 or 11/16 |
| 6 inches | 10/14 |
| 8 inches | 12/15 |
| 10 inches | 10/12 |
| 12 inches | 12/13 |
| 14 inches | 11/12 |
| 16 inches | 13/14 |
| 18 inches | 15/16 |
| 20 inches | 10/16 |
| 22 inches | 10/13 |
| 24 inches | 10/11 |

FIG. 3

| To Achieve Desired Height Differential of: | Step Between A/B |
|---|---|
| 2 inches | 10/15 |
| 4 inches | 13/14 |
| 6 inches | 12/15 |
| 8 inches | 10/12 |
| 10 inches | 11/16 |
| 12 inches | 15/16 |
| 14 inches | 10/16 |
| 16 inches | 11/12 |
| 18 inches | 12/13 |
| 20 inches | 14/15 |
| 22 inches | 10/14 |
| 24 inches | 10/11 |
| 26 inches | 10/13 |

FIG. 7

THERAPEUTIC AND RECREATIONAL VARIABLE STEPPING APPARATUS AND METHOD

FIELD OF THE INVENTION

This invention relates generally to therapeutic and exercise devices and methods, and particular, to step-up and step-down exercises using an apparatus needing no adjustment to enable stepping over a wide range of step height differentials.

BACKGROUND OF THE INVENTION

Stepping exercise devices have become increasingly popular for both therapy and recreation. Complex and expensive power-operated stepping devices having in fact become a standard, recognizable item of equipment at health spas throughout the United States and the world. Such stepping devices are commonly used in recreational and rehabilitation environments for exercise, assessments and training, and are also used in clinical settings for testing and research.

Of course, the users of these devices often possess a wide variation of physical capacities from one user to the next, which requires electronic or physical adjustment of the settings associated with the device. As a result, stepping devices are typically costly, electronically or physically complex, and heavy.

OBJECTS OF THE INVENTION

It would be desirable to have available a low cost, simple stepping device which can be used by people possessing a wide range physical capacities without any electronic or physical adjustment whatsoever for usage from one person to the next.

In particular, it would be desirable for such a stepping device to require no electrical power whatsoever, and to have no mechanical moving parts whatsoever, while still enabling use by such people of varying physical capability.

It would further be desirable for such a stepping device to enable stepping over a wide range of step height differentials ranging, for example, from 2 to 24 inches and even 26, with differential step increments, for example, of approximately 2 inches.

That is, it would be desirable for such a device to provide step height differentials of approximately 2, 4, 6, 8, 10, 12, 14, 16, 18, 20, 22 and 24 inches, and even 26 inches, as desired by the user, without any power or electronics, without any mechanical moving parts, and without any adjustment whatsoever from one user to the next.

It is further desirable for such a device to be lightweight, and hence easily portable.

SUMMARY OF THE INVENTION

In a preferred embodiment, six steps of varying height are provided adjacent to one another in an integrated unit resting upon and surrounded by a floor surface. The height of each step in relation to its adjacent steps, and in relation to the floor, is determined such that by stepping between any chosen pair of adjacent steps, or by stepping between the floor and any given single step, step height differentials of approximately 2, 4, 6, 8, 10, 12, 14, 16, 18, 20, 22, 24, and optionally 26 inches are all made available to the user.

BRIEF DESCRIPTION OF THE DRAWING

The features of the invention believed to be novel are set forth in the appended claims. The invention, however, together with further objects and advantages thereof, may best be understood by reference.to the following description taken in conjunction with the accompanying drawing(s) in which:

FIG. 2 is a chart illustrating the height of each of the six steps of FIG. 1 above the floor, in the first preferred embodiment.

FIG. 3 is a chart illustrating the step height differentials achieved by stepping between the floor and any of these six steps, and between any adjacent pair of these six steps, using the heights illustrated in FIG. 2.

FIGS. 5 and 6 are a top plan view and associated chart, respectively, illustrating a second preferred embodiment of the invention providing step height differentials ranging from approximately 2 inches to 26 inches, by 2 inch increments.

FIG. 7 is a chart illustrating the step height differentials achieved by stepping between the floor and any of the six steps, and between any adjacent pair of the six steps, using the heights illustrated in FIG. 6.

DETAILED DESCRIPTION OF THE INVENTION

Figure 1:
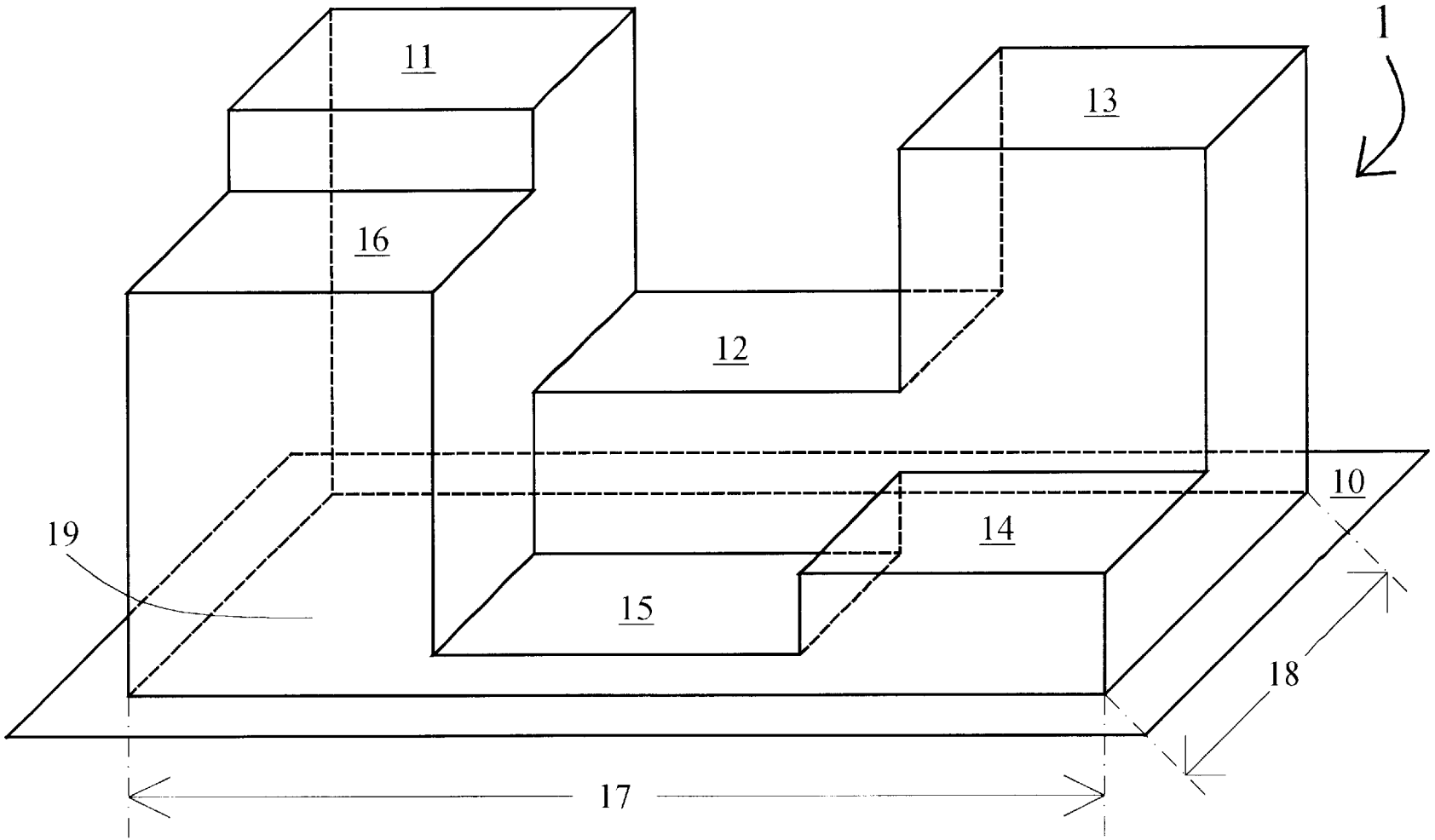
FIG. 1 is a top-right-front perspective view illustrating a configuration of six steps which, in a first preferred embodiment, provides step height differentials ranging from approximately 2 inches to 24 inches, by 2 inch increments.

FIG. 1 illustrates a therapeutic and recreational variable stepping apparatus 1 in a first embodiment of the invention utilizing a total of six steps 11, 12, 13, 14, 15 and 16, configured in a 2 step by 3 step arrangement. As illustrated, a common bottom plane 19 of stepping apparatus 1, and particularly the common bottom plane 19 of said steps 11, 12, 13, 14, 15 and 16, is rested upon a substantially flat floor surface 10. Dashed lines illustrate hidden edges of stepping apparatus 1. Each of the six steps 11, 12, 13, 14, 15 and 16 comprises a horizontal top surface thereof, where the reference numerals therefor have been placed.

By simple mathematical calculation, one can deduce that for any similar 2 step by 3 step arrangement, there are in general six step height differentials which can be achieved by stepping between floor 10 and one of the six steps 11, 12, 13, 14, 15 and 16. Additionally, there are seven step height differentials which can be achieved by stepping between any one of the six steps 11, 12, 13, 14, 15 and 16 and its longitudinal or latitudinal adjacent step (to be referred to as its "directly adjacent" step), since there are seven distinct pairs of such directly adjacent steps ("adjacent step pairs"). This yields a total of 13 step height differentials for any such 2 step by 3 step arrangement.

On the other hand, the desired step height differentials of approximately 2, 4, 6, 8, 10, 12, 14, 16, 18, 20, 22 and 24 inches as noted above, represent a total of 12 step height differentials. So, it appears hopeful that by the clever selection of step heights for each of the six steps 11, 12, 13, 14, 15 and 16, one might in fact be able to achieve the 12 desired step height differentials, with an extra, 13th, duplicate step height differential as well.

Referring to FIG. 1, as viewed from above, and moving from the left rear step 11 around stepping apparatus 1 in a clockwise direction, the preferred heights of each of six steps 11, 12, 13, 14, 15 and 16 above floor 10 are selected to be approximately 24, 10, 22, 6, 2, and 20 inches, respectively, as summarized by the chart of FIG. 2.

By virtue of this configuration of step heights and interrelationships, the desired preferred step height differentials of approximately 2, 4, 6, 8, 10, 12, 14, 16, 18, 20 20, 22 and 24 inches can in fact be achieved by stepping from floor 10 to one of the six steps 11, 12, 13, 14, 15 and 16, or by stepping from any one of the six steps 11, 12, 13, 14, 15 and 16 to its directly adjacent step. This is summarized by the chart of FIG. 3.

Thus, for a 2 inch step height differential, one steps between floor 10 and step 15. For a 4 inch step height differential, one has the choice of stepping between step 14 and step 15, or between step 11 and step 16. This is in fact the duplicate step height differential referred to earlier. For a 6 inch step height differential, one steps between floor 10 and step 14. For an 8 inch step height differential, one steps between step 12 and step 15. For a 10 inch step height differential, one steps between floor 10 and step 12. For a 12 inch step height differential, one steps between step 12 and step 13. For a 14 inch step height differential, one steps between step 11 and step 12. For a 16 inch step height differential, one steps between step 13 and step 14. For an 18 inch step height differential, one steps between step 15 and step 16. For a 20 inch step height differential, one steps between floor 10 and step 16. For a 22 inch step height differential, one steps between floor 10 and step 13. Finally, for a 24 inch step height differential, one steps between floor 10 and step 11.

A preferred "footprint" for stepping apparatus 1 is approximately 48 inches in width 17, by approximately 30 inches in depth 18. With these preferred footprint dimensions, each of the four corner steps 11, 13, 14, and 16 is a square 15 inches wide by 15 inches deep, while the two middle steps 12 and 15 are each 18 inches wide by 15 inches deep. However, these dimensions can readily be varied within the scope of the invention such that each single step has linear dimensions as small as perhaps 10 or 12, or even 4 to 6 or 8 inches to accommodate a very small foot size and stepping distance such as those of small children, and as large as 24, 30, or even 36 inches to provide very ample stepping room for large adults or athletes. The dimensions chosen for any particular embodiment should provide enough space for the user's feet, as well as proper room for comfortable stepping between floor 10 and any of the steps 11, 12, 13, 14, 15 and 16, and between adjacent pairs of steps 11, 12, 13, 14, 15 and 16. These dimensions should also be chosen so as to provide an overall footprint for stepping apparatus 1 that will not utilize a great deal of floor space, and that enables stepping apparatus 1 to be light enough for easy lifting by a single individual and thus easily portable. It is to be observed that FIGS. 1 and 4 are drawn substantially to scale for the preferred heights, widths and depths described above.

Figure 4:
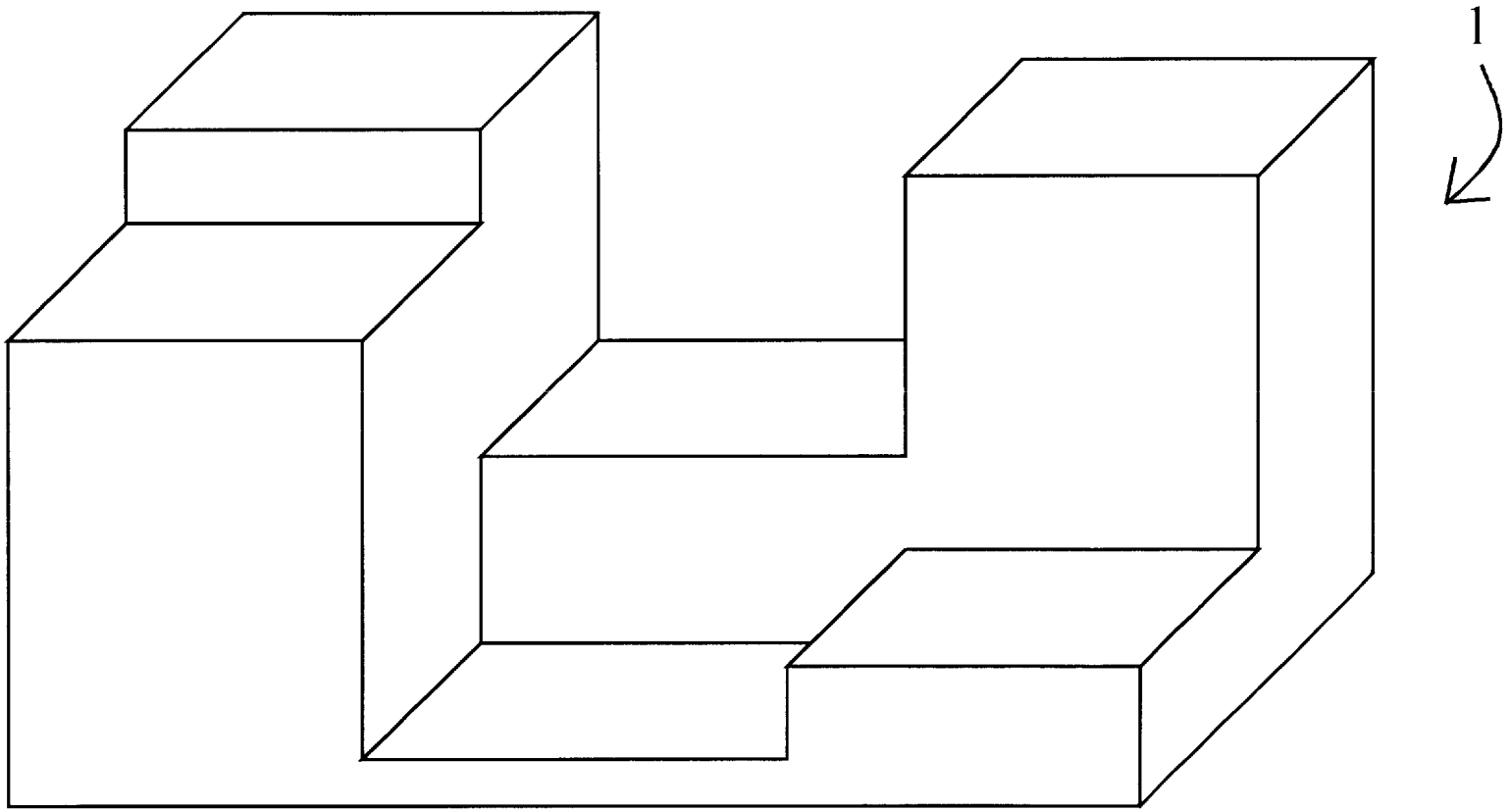
FIG. 4 is a perspective view similar to FIG. 1, but with hidden line matter removed.

It is also to be understood, while the embodiment illustrated in FIGS. 1 and 4, for the step heights and step height differentials specified in FIGS. 2 and 3, yields step. height differentials ranging from 2 inches to 24 inches by 2 inch step increments, that the step heights specified in FIG. 2 can of course be continuously scaled by any chosen predetermined factor between, for example, 0.25 and 2.0. Thus, for example, if all of the heights specified in FIG. 2 were to be scaled (multiplied) by a factor of 0.25, one would achieve step height differentials ranging from 0.5 inches to 6 inches, by 0.5 inch step increments. Similarly, for example, if all of the heights specified in FIG. 2 were to be scaled by a factor of 2.0, one would achieve step height differentials ranging from 4 inches to 48 inches, by 4 inch step increments. Scaling by a factor less than 1.0 thus results in an easier stepping apparatus 1 which might be used, for example, by children. Scaling by a factor toward greater than 1.0 results in a more difficult stepping apparatus 1 which might be used, for example, for training professional athletes.

Generally, therefore, if x=the desired, predetermined step increment as measured in linear distance units (x=2 inches in the first preferred embodiment), then the six step configuration of FIG. 1 enables step height differentials of all of x, 2x, 3x, 4x, 5x, 6x, 7x, 8x, 9x, 10x, 11x and 12x.

It is also to be understood, that the configuration of steps 11, 12, 13, 14, 15 and 16 relative to one another might also be varied or rearranged, and, so long as a similar result is achieved insofar as step height differentials and step increments as described above is concerned, that any such variation or rearrangement is considered to fall within the scope of this disclosure and its associated claims.

Stepping apparatus 1 may be constructed from a broad range of materials, including, but not limited to, wood, plastic, metal, and rubber, separately or in combination. It is preferred that at least the surface which comes in contact with the user's feet be made of a non-slip, shock-absorbing material such as rubber, for safety and comfort. Floor surface 10 further comprises an optional non-slip, shock-absorbing mat surrounding stepping apparatus 1, again, for safety and comfort. The materials or combination of materials chosen, preferably, should also be lightweight yet strong and durable. On the other hand, for a gymnasium or similar space where stepping apparatus 1 is to be used in a permanent, fixed location, a heavier, less-movable material may be desired.

Stepping apparatus 1 is used to create a recreational or therapeutic environment, for exercise, training, or assessment. Tasks which can be assessed or trained include, but are not limited to, step-up and step-down, sit-to-stand, lunge-to-step, and plyometric depth jumps. In the preferred embodiment, stepping apparatus 1 provides 2 to 24 inch step height differential variability, as opposed to an invariable, fixed 8 inch step height differential that is common in the art. As noted, this may be scaled to higher or lower predetermined step height differentials as desired. Stepping apparatus 1 further enables variability in all three functional planes of movement. Suitably constructed, this device is stable and strong enough for users and patients of all sizes, as well as for the addition of external loads such as dumbbells or medicine balls.

Stepping apparatus 1 is an extremely simple device, which requires no electrical power, which has no mechanical moving parts, and which requires no adjustment to achieve a total of at least 12, and possibly 13 different step height differentials, using a total of only six steps in a 2 step by 3 step configuration.

Figure 5:
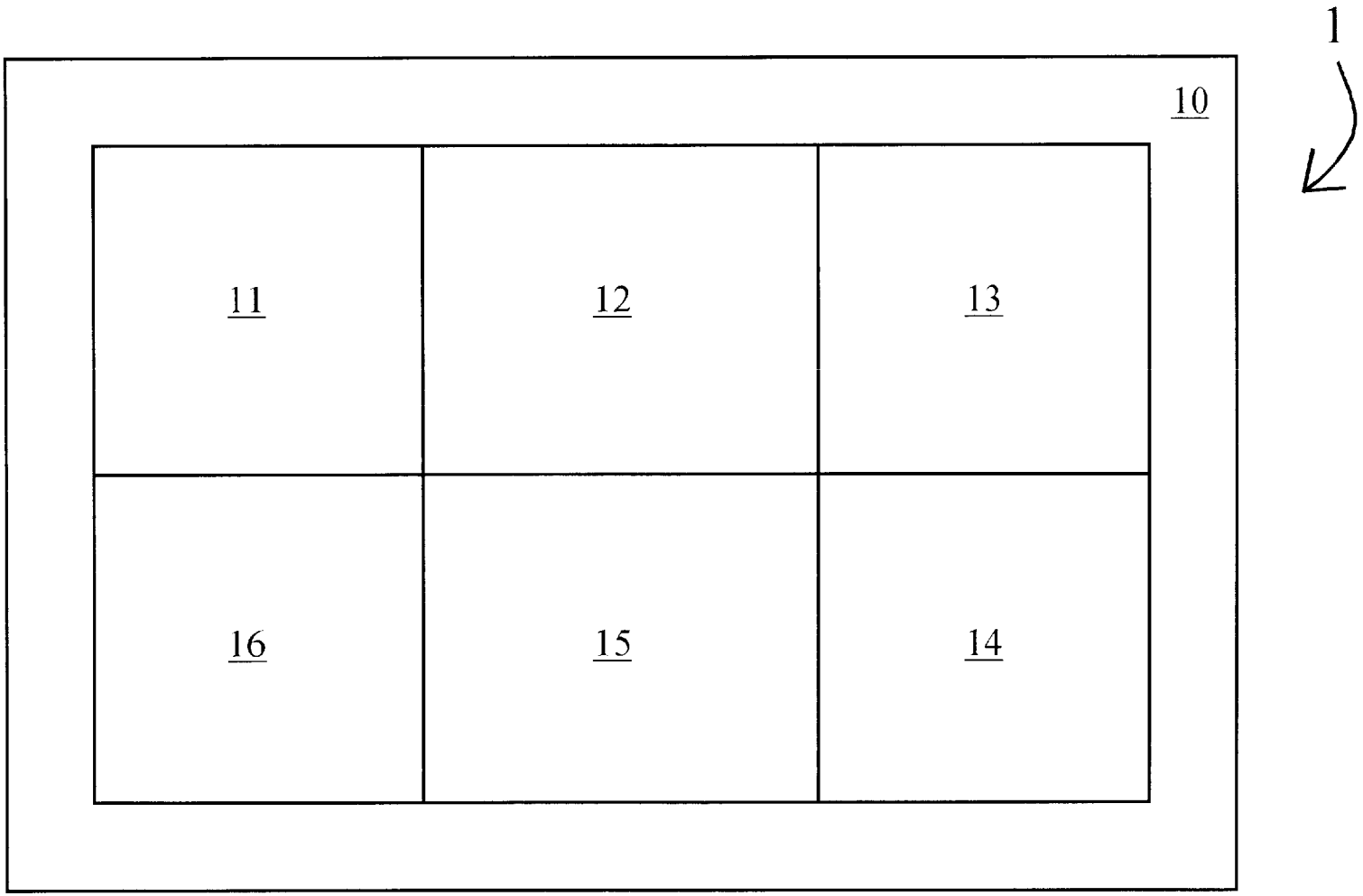

FIG. 5 illustrates a top plan view of stepping apparatus 1 generally. FIG. 6 illustrates a height assignment for these steps that now takes full advantage of all 13 available stepping combinations (6 between floor 10 and one of steps 11, 12, 13, 14, 15 and 16; 7 between pairs of directly adjacent steps), enabling step height differentials of all of x, 2x, 3x, 4x, 5x, 6x, 7x, 8x, 9x, 10x, 11x and 12x, and also, 13x. This is a second preferred embodiment of the invention. For the preferred predetermined step increment x=2 inches, this yields step height differentials ranging from 2 inches to 26 inches, rather than 24 inches as before. FIG. 7, similarly to FIG. 3, illustrates how these step height differentials are achieved using the height assignments of FIG. 6. Aside from the different step height assignments, all of the considerations outlined above for the first preferred embodiment also apply to this second preferred embodiment.

Referring to FIG. 5, it is to be observed generally, irrespective of embodiment, that the six steps 11, 12, 13, 14, 15 and 16 are configured proximate one another in a two step by three step configuration comprising two rows of three steps each. The first row comprises first step 11; third step 13; and second 12 step directly adjacent to and between first step 11 and third step 13 within this first row. The second row comprises fourth step 14 directly adjacent to third step 13 across the first and second rows; sixth step 16 directly adjacent to first step 11 across the first and second rows; and fifth step 15 directly adjacent to and between fourth step 14 and sixth step 16 within the second row, and also directly adjacent to second step 12 across the first and second rows.

Figure 8:
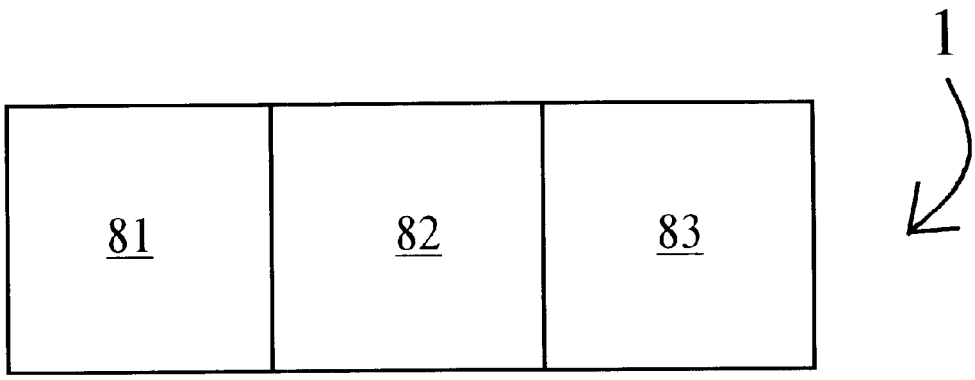
FIG. 8 illustrates an alternative embodiment of the invention using three steps with 5 height differentials.

FIG. 8 illustrates a three-step embodiment of the invention. With three steps all in a row as illustrated, one can achieve a total of five height differentials, namely, three differentials from the floor to the three steps, and two differentials as between directly adjacent steps. For example, if step 81 is 10 inches (or 10x generally), step 82 is 2 inches (or 2x generally), and step 83 is 6 inches (or 6x generally), one can achieve 2, 4, 5 6, 8, and 10 inch stepping increments, or 2x, 4x, 6x, 8x, and 10x increments generally.

Figure 9:
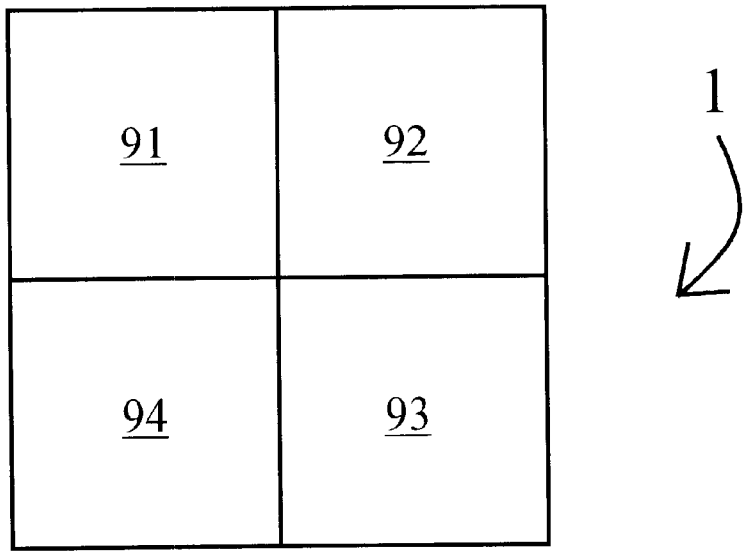
FIG. 9 illustrates an alternative embodiment of the invention using four steps with 8 height differentials.

In FIG. 9, for four steps in a two-by-two configuration, one can achieve eight differentials, four from floor to step, and four using the various available adjacent pairwise step combinations. Selecting respective dimensions of 2x, 10x, 4x and 16x for steps 91, 92, 93 and 94, one achieves 2x, 4x, 6x, 8x, 10x, 12x, 14x and 16x differentials.

Thus, more generally, the several illustrated embodiments of the invention, as well as embodiments within the scope of the invention not specifically disclosed herein, are characterized generally as:

a stepping apparatus comprising a first predetermined number of steps comprising at least three steps (embodiments have been illustrated for three, four and six steps), said steps forming a second predetermined number of directly adjacent pair combinations of said steps (two combinations for the three step embodiment, four combinations for the four step embodiment in a two-by-two configuration, seven combinations for the six step embodiment in a two-by-three configuration), each of said steps comprising distinct top surfaces thereof, said top surfaces being of different heights from one another above a common bottom plane of said steps; and a plurality of different step height differentials equal to at least the sum of: said first predetermined number of steps, plus said second predetermined number of directly adjacent pair combinations of said steps, minus 1 (i.e., at least 4=3+2−1 differentials for the three step embodiment, at least 7=4+4−1 differentials for the four step embodiment, and at least 12=6+7−1 differentials for the six step embodiment). Note that the six step embodiment was shown both for 12 differentials (FIGS. 2 and 3, hence the "minus 1") and for 13 differentials (FIGS. 6 and 7).

The use of a similar approach for other than the three, four, and six step embodiments specifically illustrated and discussed herein is considered to be within the scope of this disclosure and its associated claims.

While only certain preferred features of the invention have been illustrated and described, many modifications and changes will occur to those skilled in the art. It is, therefore, to be understood that the appended claims are intended to cover all such modifications and changes as fall within the true spirit of the invention.

I claim:

1. A stepping apparatus comprising:

a first predetermined number of steps comprising at least three steps, said steps forming a second predetermined number of directly adjacent pair combinations of said steps, each of said steps comprising distinct top surfaces thereof, said top surfaces being of different heights from one another above a common bottom plane of said steps;

a plurality of different step height differentials equal to at least the sum of: said first predetermined number of steps, plus said second predetermined number of directly adjacent pair combinations of said steps, minus 1:

said first predetermined number of steps being equal to six;

said plurality of different step height differentials being equal to at least twelve:

six of said at least twelve step height differentials defined by heights of said top surfaces of each of said six steps above said common bottom plane; and at least six others of said at least twelve step height differentials defined by height differences between said top surfaces of directly adjacent pairs of said six steps;

wherein:

said steps are sized and configured to support a user stepping thereon.

2. The stepping apparatus of claim 1:

said at least six others of said at least twelve step height differentials comprising seven step height differentials; and said at least twelve different step height differentials thereby comprising thirteen step height differentials.

3. The stepping apparatus of claim 1, said six steps configured proximate one another in two rows of three steps each:

a first one of said two rows comprising:

a first step;

a third step; and a second step directly adjacent to and between said first step and said third step within said first row; and a second one of said two rows comprising:

a fourth step directly adjacent to said third step across said first and second rows;

a sixth step directly adjacent to said first step across said first and second rows; and a fifth step directly adjacent to and between said fourth step and said sixth step within said second row, and also directly adjacent to said second step across said first and second rows.

4. The stepping apparatus of claim 2, said six steps configured proximate one another in two rows of three steps each:

a first one of said two rows comprising:

a first step;

a third step; and a second step directly adjacent to and between said first step and said third step within said first row; and a second one of said two rows comprising:

a fourth step directly adjacent to said third step across said first and second rows;

a sixth step directly adjacent to said first step across said first and second rows; and a fifth step directly adjacent to and between said fourth step and said sixth step within said second row, and also directly adjacent to said second step across said first and second rows.

5. The stepping apparatus of claim 3, wherein x designates a desired predetermined step increment measured in linear distance units, and wherein:

the top surface of said first step is approximately 12x above said common bottom plane;

the top surface of said second step is approximately 5x above said common bottom plane;

the top surface of said third step is approximately 11x above said common bottom plane;

the top surface of said fourth step is approximately 3x above said common bottom plane;

the top surface of said fifth step is approximately x above said common bottom plane; and the top surface of said sixth step is approximately 10x above said common bottom plane.

6. The stepping apparatus of claim 4, wherein x designates a desired predetermined step increment measured in linear distance units, and wherein:

the top surface of said first step is approximately 12x above said common bottom plane;

the top surface of said second step is approximately 4x above said common bottom plane;

the top surface of said third step is approximately 13x above said common bottom plane;

the top surface of said fourth step is approximately 11x above said common bottom plane;

the top surface of said fifth step is approximately x above said common bottom plane; and the top surface of said sixth step is approximately 7x above said common bottom plane.

7. The stepping apparatus of claim 5, wherein, as a consequence of said heights of said top surfaces of said steps above said common bottom plane, said at least twelve different step height differentials further comprise:

a step height differential of approximately x between said common bottom plane and said fifth step;

a step height differential of approximately 2x between said fourth step and said fifth step; as well as a duplicate step height differential of approximately 2x between said first step and said sixth step;

a step height differential of approximately 3x between said common bottom plane and said forth step;

a step height differential of approximately 4x between said second step and said fifth step;

a step height differential of approximately 5x between said common bottom plane and said second step;

a step height differential of approximately 6x between said second step and said third step;

a step height differential of approximately 7x between said first step and said second step;

a step height differential of approximately 8x between said third step and said forth step;

a step height differential of approximately 9x between said fifth step and said sixth step;

a step height differential of approximately 10x between said common bottom plane and said sixth step;

a step height differential of approximately 11x between said common bottom plane and said third step; and a step height differential of approximately 12x between said common bottom plane and said first step.

8. The stepping apparatus of claim 6, wherein, as a consequence of said heights of said top surfaces of said steps above said common bottom plane, said thirteen height differentials further comprise:

a step height differential of approximately x between said common bottom plane and said fifth step;

a step height differential of approximately 2x between said third step and said forth step;

a step height differential of approximately 3x between said second step and said fifth step;

a step height differential of approximately 4x between said common bottom plane and said second step;

a step height differential of approximately 5x between said first step and said sixth step;

a step height differential of approximately 6x between said fifth step and said sixth step;

a step height differential of approximately 7x between said common bottom plane and said sixth step;

a step height differential of approximately 8x between said first step and said second step;

a step height differential of approximately 9x between said second step and said third step;

a step height differential of approximately 10x between said forth step and said fifth step;

a step height differential of approximately 11x between said common bottom plane and said forth step;

a step height differential of approximately 12x between said common bottom plane and said first step; and a step height differential of approximately 13x between said common bottom plane and said third step.

9. The stepping apparatus of claim 5, wherein said x is between approximately 0.5 inches and 4 inches.

10. The stepping apparatus of claim 6, wherein said x is between approximately 0.5 inches and 4 inches.

11. The stepping apparatus of claim 7, wherein said x is between approximately 0.5 inches and 4 inches.

12. The stepping apparatus of claim 8, wherein said x is between approximately 0.5 inches and 4 inches.

13. A stepping apparatus comprising:

a first predetermined number of steps comprising at least three steps, said steps forming a second predetermined number of directly adjacent pair combinations of said steps, each of said steps comprising distinct top surfaces thereof, said top surfaces being of different heights from one another above a common bottom plane of said steps;

a plurality of different step height differentials equal to at least the sum of: said first predetermined number of steps, plus said second predetermined number of directly adjacent pair combinations of said steps, minus 1:

said first predetermined number of steps being equal to three;

said plurality of different step height differentials being equal to five:

three of said five height differentials defined by heights of said top surfaces of each of said three steps above said common bottom plane; and two others of said five height differentials defined by height differences between said top surfaces of directly adjacent pairs of said three steps; wherein:

said steps are sized and configured to support a user stepping thereon;

x designates a desired predetermined step increment measured in linear distance units; and said different heights of said top surfaces of said steps above said common bottom plane are chosen such that all of said step height differentials are approximately integer multiples of x comprising all of 1x through 5x.

14. The stepping apparatus of claim 13, said three steps configured proximate one another in a single row of three steps comprising:

a first step;

a third step; and a second step directly adjacent to and between said first step and said third step; wherein the top surface of said first step is approximately 5x above said common bottom plane;

the top surface of said second step is approximately x above said common bottom plane;

the top surface of said third step is approximately 3x above said common bottom plane.

15. The stepping apparatus of claim 14, wherein, as a consequence of said heights of said top surfaces of said steps above said common bottom plane, said five height differentials further comprise:

a step height differential of approximately x between said common bottom plane and said second step;

a step height differential of approximately 2x between said second step and said third step;

a step height differential of approximately 3x between said common bottom plane and said third step;

a step height differential of approximately 4x between said second step and said first step;

a step height differential of approximately 5x between said common bottom plane and said first step.

16. The stepping apparatus of claim 15, wherein said x is between approximately 0.5 inches and 4 inches.

17. A stepping apparatus comprising:

a first predetermined number of steps comprising at least three steps, said steps forming a second predetermined number of directly adjacent pair combinations of said steps, each of said steps comprising distinct top surfaces thereof, said top surfaces being of different heights from one another above a common bottom plane of said steps; and a plurality of different step height differentials equal to at least the sum of: said first predetermined number of steps, plus said second predetermined number of directly adjacent pair combinations of said steps, minus 1:

said first predetermined number of steps being equal to four;

said plurality of different step height differentials being equal to eight:

four of said eight height differentials defined by heights of said top surfaces of each of said four steps above said common bottom plane; and four others of said eight height differentials defined by height differences between said top surfaces of directly adjacent pairs of said four steps; wherein said steps are sized and configured to support a user stepping thereon;

x designates a desired predetermined step increment measured in linear distance units; and said different heights of said top surfaces of said steps above said common bottom plane are chosen such that all of said step height differentials are approximately integer multiples of x comprising all of 1x through at least 7x.

18. The stepping apparatus of claim 17, said four steps configured proximate one another in two rows of two steps each:

a first one of said two rows comprising:

a first step; and a second step directly adjacent to said first step within said first row; and a second one of said two rows comprising:

a third step directly adjacent to said second step across said first and second rows;

a fourth step directly adjacent to said first step across said first and second rows; wherein the top surface of said first step is approximately x above said common bottom plane;

the top surface of said second step is approximately 5x above said common bottom plane;

the top surface of said third step is approximately 2x above said common bottom plane; and the top surface of said fourth step is approximately 8x above said common bottom plane.

19. The stepping apparatus of claim 18, wherein, as a consequence of said heights of said top surfaces of said steps above said common bottom plane, said thirteen height differentials further comprise:

a step height differential of approximately x between said common bottom plane and said first step;

a step height differential of approximately 2x between said common bottom plane and said third step;

a step height differential of approximately 3x between said second step and said third step;

a step height differential of approximately 4x between said first step and said second step;

a step height differential of approximately 5x between said common bottom plane and said second step;

a step height differential of approximately 6x between said third step and said fourth step;

a step height differential of approximately 7x between said first step and said fourth step;

a step height differential of approximately 8x between said common bottom plane and said fourth step.

20. The stepping apparatus of claim 19, wherein said x is between approximately 0.5 inches and 4 inches.

21. A stepping apparatus comprising six steps of different heights from one another above a common bottom plane of said six steps, said steps configured proximate one another in two rows of three steps each:

a first one of said two rows comprising:

a first step;

a third step; and a second step directly adjacent to and between said first step and said third step within said first row; and a second one of said two rows comprising:

a fourth step directly adjacent to said third step across said first and second rows;

a sixth step directly adjacent to said first step across said first and second rows; and a fifth step directly adjacent to and between said fourth step and said sixth step within said second row, and also directly adjacent to said second step across said first and second rows; wherein x designates a desired predetermined step increment measured in linear distance units, and wherein:

the top surface of said first step is approximately 12x above said common bottom plane;

the top surface of said second step is approximately 5x above said common bottom plane;

the top surface of said third step is approximately 11x above said common bottom plane;

the top surface of said fourth step is approximately 3x above said common bottom plane;

the top surface of said fifth step is approximately x above said common bottom plane; and the top surface of said sixth step is approximately 10x above said common bottom plane; wherein: said steps are sized and configured to support a user stepping thereon.

22. The stepping apparatus of claim 21, wherein, as a consequence of said heights of said top surfaces of said steps above said common bottom plane, there are twelve different step height differentials comprising:

a step height differential of approximately x between said common bottom plane and said fifth step;

a step height differential of approximately 2x between said fourth step and said fifth step; as well as a duplicate step height differential of approximately 2x between said first step and said sixth step;

a step height differential of approximately 3x between said common bottom plane and said forth step;

a step height differential of approximately 4x between said second step and said fifth step;

a step height differential of approximately 5x between said common bottom plane and said second step;

a step height differential of approximately 6x between said second step and said third step;

a step height differential of approximately 7x between said first step and said second step;

a step height differential of approximately 8x between said third step and said forth step;

a step height differential of approximately 9x between said fifth step and said sixth step;

a step height differential of approximately 10x between said common bottom plane and said sixth step;

a step height differential of approximately 11x between said common bottom plane and said third step; and a step height differential of approximately 12x between said common bottom plane and said first step.

23. The stepping apparatus of claim 21, wherein said x is between approximately 0.5 inches and 4 inches.

24. The stepping apparatus of claim 22, wherein said x is between approximately 0.5 inches and 4 inches.

25. A stepping apparatus comprising six steps of different heights from one another above a common bottom plane of said six steps, said steps configured proximate one another in two rows of three steps each:

a first one of said two rows comprising:

a first step;

a third step; and a second step directly adjacent to and between said first step and said third step within said first row; and a second one of said two rows comprising:

a fourth step directly adjacent to said third step across said first and second rows;

a sixth step directly adjacent to said first step across said first and second rows; and a fifth step directly adjacent to and between said fourth step and said sixth step within said second row, and also directly adjacent to said second step across said first and second rows; wherein x designates a desired predetermined step increment measured in linear distance units, and wherein:

the top surface of said first step is approximately 12x above said common bottom plane;

the top surface of said second step is approximately 4x above said common bottom plane;

the top surface of said third step is approximately 13x above said common bottom plane;

the top surface of said fourth step is approximately 11x above said common bottom plane;

the top surface of said fifth step is approximately x above said common bottom plane; and the top surface of said sixth step is approximately 7x above said common bottom plane; wherein: said steps are sized and configured to support a user stepping thereon.

26. The stepping apparatus of claim 25, wherein, as a consequence of said heights of said top surfaces of said steps above said common bottom plane, there are thirteen different step height differentials comprising:

a step height differential of approximately x between said common bottom plane and said fifth step;

a step height differential of approximately 2x between said third step and said forth step;

a step height differential of approximately 3x between said second step and said fifth step;

a step height differential of approximately 4x between said common bottom plane and said second step;

a step height differential of approximately 5x between said first step and said sixth step;

a step height differential of approximately 6x between said fifth step and said sixth step;

a step height differential of approximately 7x between said common bottom plane and said sixth step;

a step height differential of approximately 8x between said first step and said second step;

a step height differential of approximately 9x between said second step and said third step;

a step height differential of approximately 10x between said forth step and said fifth step;

a step height differential of approximately 11x between said common bottom plane and said forth step;

a step height differential of approximately 12x between said common bottom plane and said first step; and a step height differential of approximately 13x between said common bottom plane and said third step.

27. The stepping apparatus of claim 25, wherein said x is between approximately 0.5 inches and 4 inches.

28. The stepping apparatus of claim 26, wherein said x is between approximately 0.5 inches and 4 inches.

29. A stepping apparatus comprising:

a first predetermined number of steps comprising at least three steps, said steps forming a second predetermined number of directly adjacent pair combinations of said steps, each of said steps comprising distinct top surfaces thereof, said top surfaces being of different heights from one another above a common bottom plane of said steps; and a plurality of different step height differentials equal to at least the sum of: said first predetermined number of steps, plus said second predetermined number of directly adjacent pair combinations of said steps, minus 1:

said first predetermined number of steps being equal to $N \geqq 6$;

said second predetermined number of directly adjacent pair combinations of said steps being equal to C;

said plurality of different step height differentials being equal to at least N+C−1:

N of said at least N+C−1 height differentials defined by heights of said top surfaces of each of said N steps above said common bottom plane; and at least C−1 others of said at least N+C−1 height differentials defined by height differences between said top surfaces of directly adjacent pairs of said N steps; wherein: said steps are sized and configured to support a user stepping thereon.

30. The stepping apparatus of claim 29, wherein:

x designates a desired predetermined step increment measured in linear distance units; and said different heights of said top surfaces of said steps above said common bottom plane are chosen such that all of said step height differentials are approximately integer multiples of x comprising all of 1x through $(N+C-1)\cdot x$ for $N>3$ and all of 1x through $(N+C)\cdot x$ for $N=3$.

31. The stepping apparatus of claim 29, wherein said x is between approximately 0.5 inches and 4 inches.

32. A stepping apparatus comprising:

a first predetermined number of steps comprising at least three steps, said steps forming a second predetermined number of directly adjacent pair combinations of said steps, each of said steps comprising distinct top surfaces thereof, said top surfaces being of different heights from one another above a common bottom plane of said steps; and a plurality of different step height differentials equal to at least the sum of: said first predetermined number of steps, plus said second predetermined number of directly adjacent pair combinations of said steps, minus 1:

said first predetermined number of steps being equal to $N \geqq 3$;

said second predetermined number of directly adjacent pair combinations of said steps being equal to C;

said plurality of different step height differentials being equal to at least N+C−1 if $N>3$ and equal to N+C if $N=3$:

N of said at least N+C−1 height differentials if $N>3$ and N+C height differential if $N=3$ defined by heights of said top surfaces of each of said six steps above said common bottom plane; and at least C−1 others of said at least N+C−1 height differentials if $N>3$ and at least C others of said at least N+C height differentials if $N=3$ defined by height differences between said top surfaces of directly adjacent pairs of said N steps; wherein:

x designates a desired predetermined step increment measured in linear distance units; and said different heights of said top surfaces of said steps above said common bottom plane are chosen such that all of said step height differentials are approximately integer multiples of x comprising all of 1x through $(N+C-1)\cdot x$ for $N>3$ and all of 1x through $(N+C)\cdot x$ for $N=3$; wherein: said steps are sized and configured to support a user stepping thereon.

33. The stepping apparatus of claim 32, wherein said x is between approximately 0.5 inches and 4 inches.

* * * * *